US005396909A

United States Patent [19]

Gentry et al.

[11] Patent Number: 5,396,909

[45] Date of Patent: Mar. 14, 1995

[54] SMOKING ARTICLE FILTER

[75] Inventors: Thomas L. Gentry; William M. Coleman, III; Charles R. Ashcraft; Dennis L. Carespodi; Milly M. L. Wong, all of Winston-Salem, N.C.

[73] Assignee: R. J. Reynolds Tobacco Company, Winston-Salem, N.C.

[21] Appl. No.: 168,745

[22] Filed: Dec. 16, 1993

[51] Int. Cl.[6] ..... A24D 3/00

[52] U.S. Cl. ..... 131/332; 131/361; 55/521

[58] Field of Search ..... 131/360, 361, 331, 332, 131/29, 61.1, 71, 76, 88, 339; 55/521, 528

[56] References Cited

U.S. PATENT DOCUMENTS

| | | | |
|---|---|---|---|
| 1,957,958 | 5/1934 | Hauser et al. | 131/361 |
| 2,001,709 | 5/1935 | Davidson | 131/361 |
| 2,104,329 | 1/1938 | Levy | 131/361 |
| 2,171,770 | 9/1939 | Strauch | 131/361 |
| 3,368,566 | 2/1968 | Avedikian | 131/344 X |
| 4,517,996 | 5/1985 | Vester | 131/344 X |
| 4,881,555 | 11/1989 | Bolt et al. | 131/361 X |
| 5,025,815 | 6/1991 | Hill et al. | 131/332 |
| 5,074,320 | 12/1991 | Jones, Jr. et al. . | |
| 5,105,834 | 4/1992 | Saintsing et al. | 131/344 X |
| 5,150,722 | 9/1992 | Rutherford | 131/335 |
| 5,240,479 | 8/1993 | Bachinski | 55/521 X |
| 5,249,576 | 10/1993 | Ashcraft et al. . | |

FOREIGN PATENT DOCUMENTS

| | | | |
|---|---|---|---|
| 2804991 | 8/1979 | Germany | 131/344 |
| 1094642 | 12/1967 | United Kingdom | 131/344 |

*Primary Examiner*—Jennifer Bahr

*Attorney, Agent, or Firm*—Grover M. Myers; George C. Myers, Jr.

[57] ABSTRACT

A cigarette smoking article includes a tobacco rod and a dual filter comprising a tobacco rod end segment made of cellulose acetate tow and a mouth end segment made of a gathered, perforated polymeric film blended with a whitener to produce a substantially non-staining mouth end surface. The polymeric film may also comprise a coextruded flavor film with a flavor carrier layer disposed between a pair of barrier layers for releasing a flavorant into the mainstream smoke during smoking of the cigarette. Transparent wraps may be used to construct the cigarette from the component parts so that the filtration surfaces of the filter rod are visible through the wraps.

24 Claims, 2 Drawing Sheets

SMOKING ARTICLE FILTER

FIELD OF THE INVENTION

The present invention relates to smoking article filters and more particularly to cigarette filters which provide visual cues to encourage the smoker's favorable perception of the cigarette filter and/or the effectiveness of the filter and which are provided with flavorant additives releasable during smoking of the cigarette.

BACKGROUND OF THE INVENTION

Conventional filter cigarettes typically include a filter made of a cellulose acetate tow which becomes stained at the mouth end of the filter as the cigarette is smoked. Some smokers consider this stain to be objectionable notwithstanding the fact that the stain is a visual indicator that the filter is operating efficiently and effectively. There have been attempts to eliminate this stain or at least minimize the smoker's perception of the stain both visually and from a taste standpoint, for example, by the provision of a recess at the mouth end of the filter. However, many smokers consider the recessed-end filter also to be objectionable regardless of its effectiveness in eliminating or reducing the visual or taste perception of the stain at the mouth end of the filter.

It would be desirable therefore to provide a filter for a smoking article, such as a cigarette, in which the mouth end of the filter exhibits little or no staining during smoking. At the same time, such filter should provide filtration effectiveness equivalent or substantially equivalent to the conventional cellulose acetate filters.

It is well known to enhance or alter the taste or flavor of cigarettes providing the tobacco and/or filter of the cigarette with a flavorant additive. One problem associated with the addition of flavorants to cigarettes and cigarette filters is the migration of the flavorant from the cigarette or filter to the cigarette packaging material or to the surroundings when the cigarette package is opened. It would be desirable to incorporate a flavorant additive in a cigarette in such a way that migration of the flavorant prior to smoking the cigarette is minimized but that upon lighting and smoking the cigarette, release of the flavorant additive is accelerated so that it is readily perceived by the smoker.

SUMMARY OF THE INVENTION

The present invention is directed to a smoking article filter that provides equivalent or substantially equivalent filtration as the prior art cigarette filters, but visually exhibits a relatively clean mouth end during smoking and thus avoids the heavy staining at the mouth end of the filter in prior art cigarettes that some smokers find objectionable. The filter of the invention may also be provided with a flavorant additive which is substantially non-migrating and releasable during smoking of the cigarette.

According to one embodiment of the invention, the filter is made in at least two segments. The tobacco rod end segment is preferably made of conventional condensed cellulose acetate tow wrapped with a standard plug wrap, but may also be made of a cellulose acetate web, a gathered paper, including tobacco paper, a gathered polymer or any other suitable filtration media. If desired, the tobacco rod end segment can incorporate inorganic or organic materials, such as carbon, molecular sieve material, metal(s), alumina or the like, to modify or reduce certain constituents of the mainstream smoke. The segment may also include pH modifiers and/or flavor additives to enhance or alter the taste acceptance for various cigarette styles.

The mouth end segment is made of a rod of perforated, gathered polymeric film. Any polymeric film suitable for gathering into rod form may be used. Prior to gathering, the film may be perforated, e.g., mechanically, laser, etc., with a plurality of small holes. Advantageously, the holes facilitate gathering of the film into rod form. Preferably, the polymeric film is a 1 mil (0.001 inch) polyethylene film blended with a whitener, such as calcium carbonate ($CaCO_3$) or other suitable whitener. The polymeric film of the mouth end segment may also include components that chemically attract and bond with constituents in the mainstream smoke. Like the tobacco rod end segment, the mouth end segment may also include organic and/or inorganic materials, flavorants, etc. to modify, reduce or filter mainstream smoke constituents. If a flavorant is to be added to either filter segment, the film is preferably made of a coextrusion of at least three layers of polymeric material as described more fully hereinbelow.

The width of the film to be gathered may be varied to provide a rod having a suitable end appearance and firmness. It has been found that a twelve-inch wide perforated low density polyethylene (LDPE) film blended with a whitener and having a thickness of about 1 mil can be gathered into rod form on a modified KDF-2 filter maker manufactured by Korber AG of Hamburg, Germany using standard filter plug wrap paper. The polyethylene film is mechanically perforated from one side with a 22 hex mesh comprising 560–570 holes/in$^2$, each hole having a diameter of about 20 mils (0.020 inch) with an open mesh area of about 16%. After perforation, the effective thickness or embossed thickness of the 1 mil film is about 20–22 mils (0.020–0.022 inches). This film is available from Tredegar Film Products of Terre Haute, Ind. 47808 under the designation White X-6170 VisPore ® film.

Other single layer films, including oriented polypropylene or oriented polyester films including a suitable whitener and having a thickness in the range of 0.35–2.0 mils may also be used. For films thinner than about 1.0 mil, the perforations may not significantly facilitate gathering, however, for films having a thickness of about 1.0 mil and greater, the perforations substantially improve the ability to gather the film on the aforesaid conventional machinery. A preferred range of film thickness is about 0.5 to 1.25 mils. The size of the perforations and the number and arrangement of the perforations per square inch may also vary depending on the thickness and stiffness of the film. The degree of whiteness of the film may range from the brightest white (achromatic color of maximum lightness) to the off-whites, e.g., light grays, ivory, cream, ecru, and the like.

The polymeric film used for the mouth end filter segment may also comprise a multiple layer film preferably made .by coextrusion of two or more layers of polymeric materials. Generally speaking, coextruded films can be made with less expensive materials and provide the requisite resistance to stretching for gathering or folding the film into a filter rod form. Such multiple layer coextruded films may be used without perforations or, where necessary, because of the thickness or inherent stiffness of the film, the films may be perforated to facilitate gathering or folding of the film into rod form.

The mouth end filter segment is joined together with the tobacco rod end filter segment with a combiner wrap on a conventional filter combining machine, such as a MULFI PTC filter combiner to produce a combined dual filter rod. This dual filter rod is attached to a tobacco rod with tipping paper on a conventional cigarette making machine. The tobacco rod may be made of any suitable tobacco filler and cigarette paper wrapper. The completed cigarette and filter may include air dilution, if desired, as well as other advantageous features of known cigarette designs.

A filter made with a dual filter constructed as described above is characterized by a mouth end with a white or off-white appearance prior to smoking which is comparable to the mouth end appearance of the end of a conventional cigarette filter made with cellulose acetate tow. After the cigarette is smoked, the mouth end of the filter still exhibits a relatively white or off-white appearance with little or no staining when compared with the aforesaid conventional cigarette having a filter formed from a cellulose acetate tow. The mouth end of the filter thus appears cleaner to the smoker and thus represents a marked improvement to those smokers who consider mouth end staining of the filter objectionable.

If it is desired to incorporate a flavorant additive into the dual filter rod of the invention, one of the filter rod segments, preferably the mouth end segment, is made of a gathered, multiple layer coextruded flavor film similar to the flavor burst films described in U.S. Pat. No. 5,249,676 assigned to the assignee of this invention and the disclosure of which is incorporated herein by reference. In one embodiment of the multiple layer flavor film for the present invention, a flavor carrier layer which may be a white low density polyethylene blended with a flavorant and a whitener is coextruded between and adhesively bonded to a pair of white outer barrier layers, such as a polyethylenevinylalcohol (EVOH) film also blended with a whitener. Other polymeric materials that may be used for the flavor carrier layer and barrier layers are described in the aforesaid U.S. Pat. No. 5,249,676. Likewise, flavors that may be included in the flavor carrier layer are described in the aforesaid patent. The preferred thickness of the coextruded flavor film is in the range of 0.5 to 1.0 mils.

The flavor film is preferably perforated not only to facilitate gathering or folding of the film, but also to improve the releasability of the flavorant from the flavor film during smoking as explained hereinafter. The two barrier layers on either side of the flavor film substantially prevent release of the flavorant from the flavor carrier layer except at the edges of the flavor film around the perimeter of the film and around the perimeter of each of the perforations in the film. As explained in U.S. Pat. No. 5,249,676, it is unnecessary to fully encapsulate the flavor carrier layer with the barrier layer material in order to preserve the flavor in the flavor carrier layer for a substantial period of time at least equal to the shelf life of the product. Flavor loss studies have shown that the amount of flavor loss from the edges of the flavor carrier layer is essentially insignificant. It is believed that this is the result of an equilibrium gradient at the edges of the flavor carrier layer whereby a slight loss of flavor from that layer at the edges thereof forms an effective barrier to the passage of the flavorant from the greater mass of the flavor carrier layer located inwardly of the edges. This retention of the flavorant in the flavor carrier layer also minimizes the degree of migration of the flavorant into the cigarette packaging.

In the case of the flavor burst film of the aforesaid patent, the flavorant was released by peeling away at least one of the two barrier layers to expose the surface of the flavor carrier layer and thus release the flavor. According to the present invention, release of the flavorant from the flavor film is effected by heating the gathered film as a result of passing heated smoke through the filter segment. Heating of the film drives the flavorant to the exposed perimetrical edge of the flavor carrier layer and to the exposed circumferential edges of the perforations from where it is released into the mainstream smoke passing to the smoker's mouth. In an alternative embodiment of the flavor film, one or both of the barrier layers is made of a water soluble film, such as polyvinylalcohol (PVOH), and the film need not be perforated. When the moist, heated mainstream smoke passes over the water soluble film, the film is partially solubilized thereby releasing flavorant into the mainstream smoke.

In another aspect of the invention, the plug wrap for each filter rod segment (tobacco rod end segment and mouth end segment), the combiner wrap for the combined dual filter and the tipping paper for attaching the dual filter to a tobacco rod to make a complete filter cigarette are all made from a transparent or substantially transparent sheet or film material, such as transparent polymeric or cellulosic materials. Suitable materials include transparent oriented polypropylene and oriented polyester films, cellophane and the like. The degree of transparency or opacity of the films may vary so long as visual observation of the filter effectiveness is not substantially impaired. According to this feature of the invention, the transparent filter wraps permit the smoker to visually observe the effectiveness of the dual filter notwithstanding the fact that the end surface of the mouth end of the filter exhibits a substantially white or off-white, non-stained appearance. Since the components of the mainstream smoke removed from the smoke stream by the filter segments are trapped in the filter media, the smoker will be able to visibly see those trapped components in the filter media through the transparent wraps surrounding the filter components. Advantageously, it is unnecessary to apply lip release agents to the tipping paper when it is made of a polymeric material.

The transparent materials may also be tinted with color to provide the cigarette developer with greater flexibility in designing new cigarettes. The use of such materials in cigarette filter construction advantageously provides the possibility of achieving greater environmental compatibility, lower costs, higher manufacturing speed, greater selection of material suppliers and better compatibility with different flavorants and additives.

With the foregoing and other objects, advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
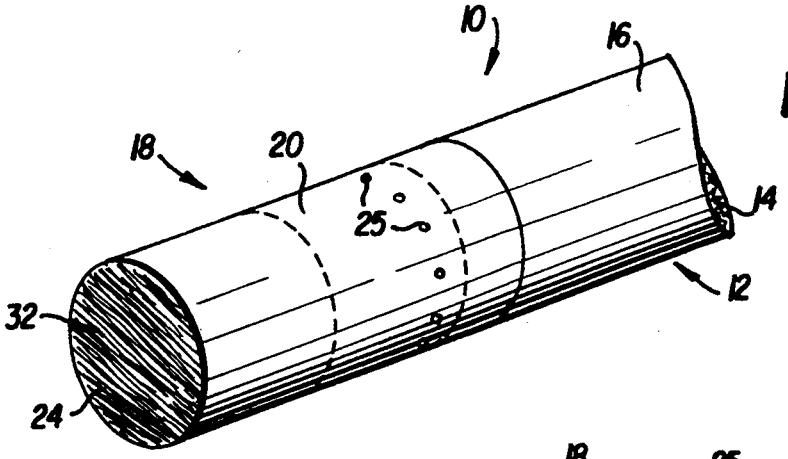
FIG. 1 is a fragmentary perspective view of a filter cigarette incorporating one embodiment of the dual filter of the present invention.
Figure 2:
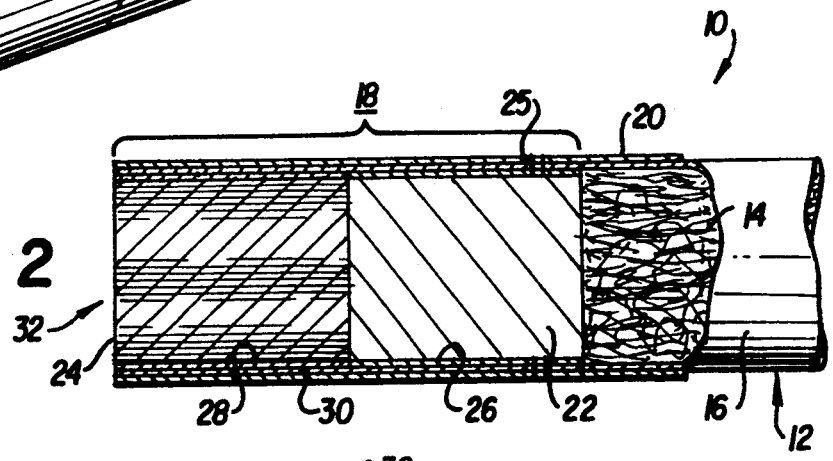
FIG. 2 is a fragmentary cross-sectional view of the filter cigarette of FIG. 1.

Referring now in detail to the drawings, there is illustrated in FIGS. 1 and 2 a first embodiment of a filter of the invention for a smoking article, such as a filter cigarette designated generally by reference numeral 10. Cigarette 10 comprises a rod 12 of smoking material which may be any suitable blend of tobacco filler 14 wrapped in a standard cigarette paper 16. The tobacco rod 12 may also be made of slit strands of reconstituted tobacco, expanded or puffed tobaccos which may incorporate other materials to alter the characteristics of the tobacco or tobacco smoke. One or more cigarette paper wrappings may be used which may be modified to alter burn rate and/or sidestream smoke and may have varying porosity.

The cigarette 10 is provided with a filter rod 18 which is attached to the tobacco rod 12 by means of a tipping paper 20. The filter rod 18 is a dual filter comprising a tobacco rod end segment 22 and a mouth end segment 24. Each of the segments 22, 24 is provided with a plug wrap 26, 28, respectively, and the segments are combined together by a combiner wrap 30. The tipping paper 20, plug wraps 26, 28 and combiner wrap 30 may be papers and wrappings conventionally used in the art.

The tobacco rod end segment 22 may be any suitable filter media and is preferably a cylindrical plug of condensed cellulose acetate tow made with a desired density according to well known processes and cut to any appropriate length, e.g., about 0.5 to about 0.75 inches, to provide an appropriate efficiency when combined with the mouth end segment. The mouth end segment 24 comprises a gathered, polymeric film, such as polyethylene, in which a whitener, such as $CaCO_3$, has been blended to provide a white appearance to the mouth end surface 32 of the filter rod 18 comparable to the white appearance of the end of a filter made with a cellulose acetate tow. A film with an off-white color may also be used. The mouth end segment 24 is cut from a rod formed of a gathered sheet of film and has a length of from about 0.25 to about 0.5 inches.

Figure 3:
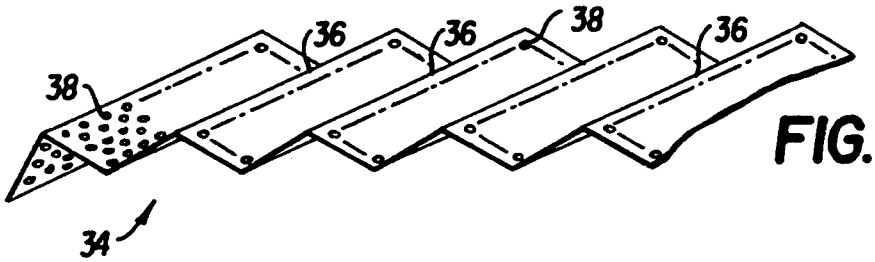
FIG. 3 is a fragmentary perspective view of a gathered film suitable for use in the filter of the filter cigarette shown in FIGS. 1 and 2.

FIG. 3 depicts the gathered sheet of film of the mouth end segment as a strip 34 of polymeric film with a plurality of creases or folds 36 formed therein from the gathering or folding process. The strip 34 is perforated with a plurality of holes 38 having a small diameter, e.g., about 20 mils. The holes 38 may be formed in staggered rows as shown in FIG. 3 or in a hex pattern and are formed by mechanical perforation although laser or other perforation processes may be used. It has been found that one suitable film is a LDPE film available from Tredegar Film Products under the designation White X-6170 VisPore® film. When the cigarette 10 is smoked, the mouth end surface 32 of the segment 24 of filter rod 18 retains its substantially white or off-white appearance with minimal staining. At the same time, the filter segments 22, 24 are as effective as conventional filters in reducing the quantity of particulate matter in the smoke flowing therethrough. Thus, the minimal staining of the cigarette filter mouth end provides the smoker with a greatly improved mouth end appearance with little or no sacrifice of taste.

By appropriate selection of the packing density and length of each filter segment 22, 24, the desired degree of filtration may be achieved by the filter rod 18 to the same or to a lesser or greater extent than conventional filters. Other filtration enhancing materials may be incorporated in the filter segments as described above. Lower tar levels may also be achieved by air dilution or ventilation holes 25 in the cigarette wrappings, preferably disposed in a circumferential array about the tobacco rod end segment 22.

Figure 4:
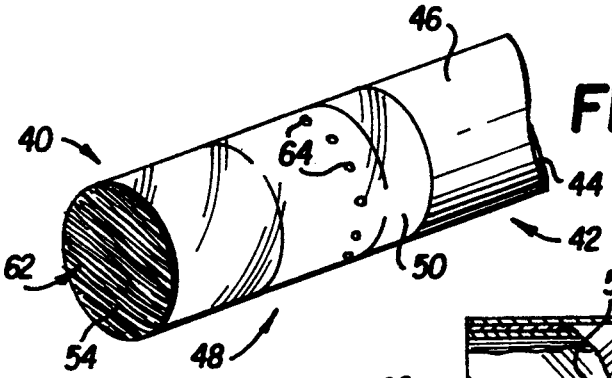
FIG. 4 is a fragmentary perspective view of a filter cigarette incorporating another embodiment of the dual filter of the present invention.
Figure 5:
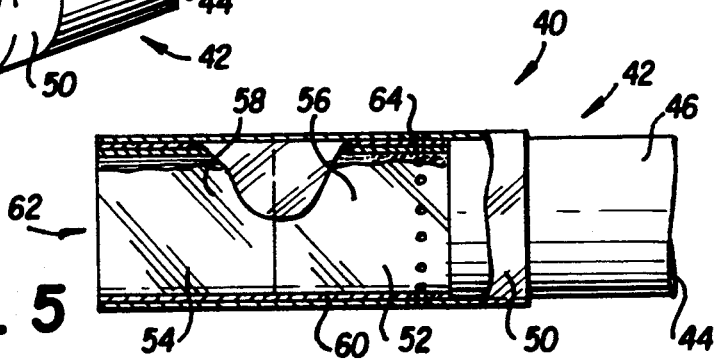
FIG. 5 is a fragmentary cross-sectional view of the filter cigarette of FIG. 4.

Referring now to FIGS. 4 and 5, there is shown a cigarette 40 comprising a tobacco rod 42 with a tobacco filler 44 and a paper wrapping 46 which may be the same as filler 14 and paper 16, respectively, of the first embodiment of the invention. Similarly, the cigarette 40 is provided with a filter rod 48 made up of two segments, namely, a tobacco rod end segment 52, and a mouth end segment 54 which may also be the same as the filter rod segments 22, 24 of the first embodiment.

The primary difference between the embodiment of FIGS. 4 and 5 and the first embodiment is that the tipping wrap 50, plug wraps 56, 58 and combiner wrap 60 are all made of a transparent or substantially transparent film, such as a polymeric or cellulosic film. These transparent wraps 50, 56, 58, 60 permit the smoker to visually observe the effectiveness of the filter during smoking by exposing to view the filter segments 52 and 54. At the same time, the cigarette 40 exhibits little or no staining of the mouth end surface 62 of the filter segment 54. This gives the smoker a greater perception of the effectiveness of the filter in removing particulate matter from the smoke than the first embodiment of the invention. Although the end surface 62 of the mouth end segment 54 remains virtually unstained, sufficient particulate matter passes through the filter rod 48 to provide the necessary taste to the cigarette. Like the first embodiment, the filter segments 52, 54 may be fabricated to provide a desired degree of filtration and may include air dilution holes 64.

Figure 6:
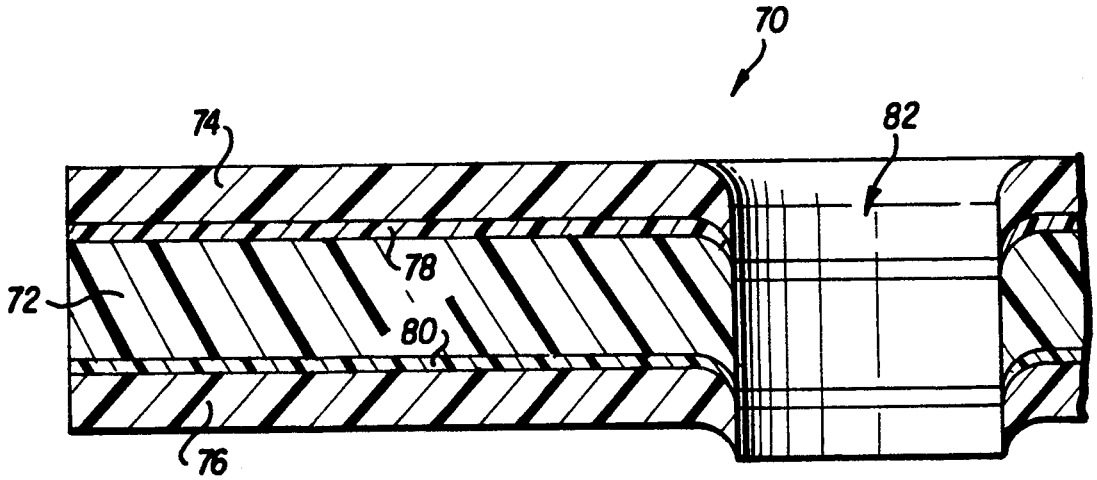
FIG. 6 is an enlarged fragmentary cross-sectional view of a perforated flavor film according to the invention.

Referring now to FIG. 6, there is illustrated in cross-section a multiple layer, coextruded sheet material designated generally by reference numeral 70. Sheet material 70 comprises a polymeric material blended with a flavorant and a whitener and two barrier layers 74, 76 each comprising a polymeric material blended with a whitener. This sheet material 70 is a flavor film similar to the flavor burst film described in the aforementioned U.S. Pat. No. 5,249,676 except that adhesive layers 78, 80 are provided between both barrier layers 74, 76 and the flavor carrier layer 72 instead of between only one carrier layer and the flavor carrier layer as disclosed in the aforesaid patent.

The sheet material 70 may be perforated with holes 82 and gathered or folded in the same manner as described above in connection with the sheet material 34 of FIG. 3 for use in the mouth end segment 24 of the dual filter 18. In a preferred embodiment, the flavor carrier layer 72 is a high density polyethylene (HDPE) having a thickness of about 0.7 mil and the barrier layers 74, 76 are polyethylenevinylalcohol (EVOH) having a thickness of about 0.1 mil. Adhesive layers 78, 80 may be a maleic anhydride modified poleyolefin adhesive having a thickness of about 0.05 to 0.1 mil. The total thickness of the preferred flavor film 70 is thus about 1.0 mil.

It will be understood that other polymeric materials having different thicknesses may be used as the flavor carrier layer, barrier layers and adhesive layers. For example, the barrier layers 74, 76 may also be made of a water soluble polymer, such as polyvinylalcohol (PVOH), with or without perforations. It would also be possible to include more than one flavor film in the core layer 72 and blend those films with the same or different flavorants having the same or different volatility or release characteristics. Although it is preferred that the flavor film 70 be used in the mouth end filter segment 24, it could also be used in the tobacco rod end filter segment 22. In such case, it would be unnecessary to include a whitener in the polymeric materials of the flavor film 70.

When a flavor film 70 is used in the mouth end filter segment or the tobacco rod end filter segment, the barrier layers 74, 76 retain substantially all the flavorant in the flavor carrier layer 72 during the shelf life of the cigarettes in which the film is used. When the cigarettes are smoked, the heated and/or moist mainstream smoke from the cigarette flows over the flavor film and releases the flavorant into the smoke to enhance or improve the taste of the cigarette.

Although only preferred embodiments are specifically illustrated and described herein, it will be appreciated that many modifications and variations of the present invention are possible in light of the above teachings and within the purview of the appended claims without departing from the spirit and intended scope of the invention.

We claim:

1. A smoking article having a longitudinal axis and comprising a rod of smoking material and a filter rod attached to said rod of smoking material, said filter rod including a mouth end segment made of a sheet of polymeric film gathered to form a plurality of folds in said film, said folds having folded edges extending substantially parallel to the longitudinal axis of the smoking article, said mouth end segment having a mouth end surface formed by a transverse edge of said sheet of film.

2. The smoking article of claim 1, wherein said polymeric film is blended with a whitener to produce a white mouth end surface.

3. The smoking article of claim 2, wherein said whitener is calcium carbonate.

4. The smoking article of claim 1, wherein said polymeric film has a plurality of perforations.

5. The smoking article of claim 4, wherein said perforations comprise holes having a substantially uniform size.

6. The smoking article of claim 5, wherein said holes are substantially circular.

7. The smoking article of claim 5, wherein said holes are formed in staggered rows or in a hex pattern.

8. The smoking article of claim 6, wherein said holes have a diameter of about 20 mils.

9. The smoking article of claim 1, wherein said smoking material is tobacco and said smoking article is a cigarette.

10. The smoking article of claim 9, wherein said filter rod further includes a tobacco rod end segment comprising a cellulose acetate tow.

11. The smoking article of claim 1, wherein said polymeric film is a polyethylene film blended with a calcium carbonate whitener, said film having a plurality of perforations.

12. The smoking article of claim 1, wherein said polymeric film is a multiple layer flavor film comprising a polymeric flavor carrier layer containing a releasable flavorant and being disposed between a pair of polymeric barrier layers for retaining the flavorant in the flavor carrier layer, said flavorant being releasable into mainstream smoke during smoking.

13. The smoking article of claim 12, wherein said polymeric film is perforated with a plurality of holes.

14. The smoking article of claim 13, wherein said flavor barrier layer is polyethylene and said barrier layers are polyethylenevinylalcohol.

15. The smoking article of claim 12, wherein said barrier layers are water, soluble polymeric layers.

16. The smoking article of claim 10, including a transparent tipping wrap for attaching said filter rod to the rod of smoking material.

17. The smoking article of claim 12, including a transparent plug wrap encircling each of said tobacco rod end segment and said mouth end segment and a transparent combiner wrap joining said segments together.

18. The smoking article of claim 17, wherein said transparent wraps are tinted with a color.

19. The smoking article of claim 10, including air dilution holes arranged circumferentially about said filter rod.

20. A cigarette having a longitudinal axis and comprising a tobacco rod and a filter rod attached to said tobacco rod, said filter rod including a mouth end segment and a tobacco rod end segment, said mouth end segment comprising a polymeric flavor film containing a whitener, said film being gathered to form a plurality of folds in said film, said folds having folded edges extending substantially parallel to the longitudinal axis of the cigarette, said tobacco rod end segment comprising a filter material, said flavor film comprising a multiple layer film, one layer of which includes a flavorant releasable into mainstream smoke during smoking of the cigarette.

21. The cigarette of claim 20, wherein said flavor film comprises a coextruded film having a flavor carrier layer containing a releasable flavorant and disposed between a pair of barrier layers for retaining the flavorant in said flavor carrier layer prior to smoking of the cigarette.

22. The cigarette of claim 21, including perforations in said flavor film for facilitating release of the flavorant from the flavor carrier layer during smoking of the cigarette.

23. A filter for a smoking article including a mouth end segment comprising a rod having a longitudinal axis and comprising a sheet of polymeric flavor film gathered to form a plurality of folds in said film, said folds having folded edges extending substantially parallel to the longitudinal axis of the rod, said flavor film having a flavor carrier layer containing a releasable flavorant and disposed between a pair of barrier layers for retaining the flavorant in said flavor carrier layer until the flavor film is contacted by mainstream smoke from a cigarette passing over the flavor film.

24. The filter rod of claim 23, wherein the layers of said flavor film contain a whitener.

* * * * *